United States Patent [19]

Annegarn

[11] 4,004,374

[45] Jan. 25, 1977

[54] DESCALING BENT ROD WITH SEPARATED CLEANING PARTICLES

[76] Inventor: Joseph Johannes Maria Annegarn, 1 Walsh Road, Kilfenora, Benoni, Transvaal, South Africa

[22] Filed: Aug. 6, 1975

[21] Appl. No.: 602,299

[30] Foreign Application Priority Data

Aug. 7, 1974 South Africa ..... 74/5031

[52] U.S. Cl. ..... 51/5 A; 51/9 R; 51/319; 51/324; 72/40; 134/7; 134/9; 134/16; 134/33

[51] Int. Cl.[2] ..... B08B 7/04; B24C 1/00; B24C 3/14

[58] Field of Search ..... 134/7, 9, 14, 16, 33; 72/40; 29/81 R; 51/5 A, 9 R, 319, 324

[56] References Cited

UNITED STATES PATENTS

| | | | |
|---|---|---|---|
| 2,005,654 | 6/1935 | Fritsche | 51/9 |
| 2,703,550 | 3/1955 | Bell | 51/5 A X |
| 3,031,802 | 5/1962 | Lelinert | 51/9 |
| 3,526,059 | 9/1970 | Trimarchi | 51/5 A |
| 3,660,943 | 5/1972 | Barnthouse | 51/9 |
| 3,699,726 | 10/1972 | Turner | 51/319 |

*Primary Examiner*—Robert L. Lindsay, Jr.
*Assistant Examiner*—Richard V. Fisher
*Attorney, Agent, or Firm*—Lane, Aitken, Dunner & Ziems

[57] ABSTRACT

A method of descaling a rod comprises forming at least one bend in the rod and rotating the bent portion in an appproximately circular path while maintaining it in a space having a distribution of separated cleaning particles therein in a suspended relationship relative thereto. The rotating bent portion strikes the distributed particles and is cleaned thereby.

11 Claims, 6 Drawing Figures

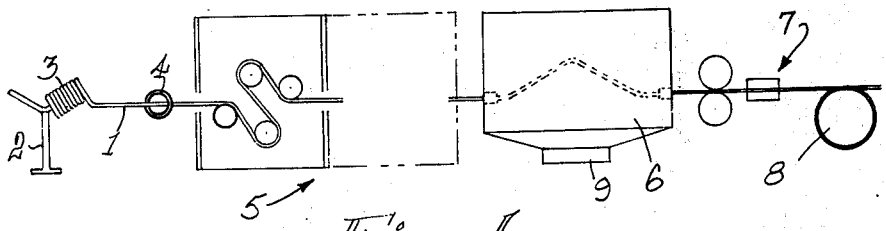
Fig 1.
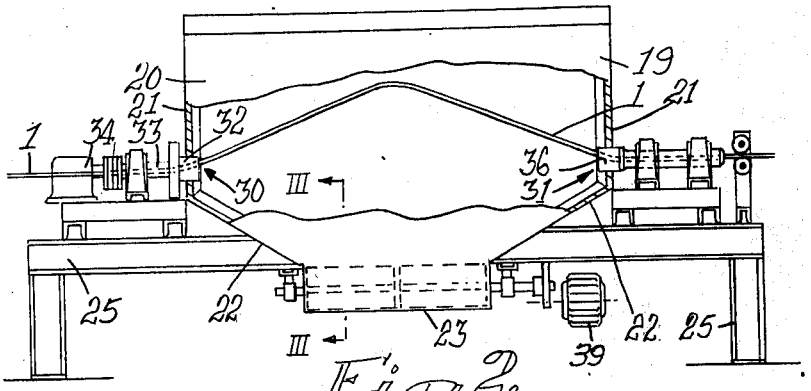
Fig 2.
Fig 3.
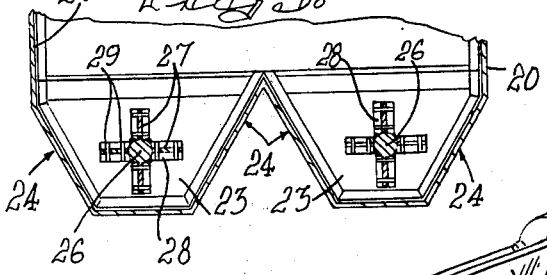
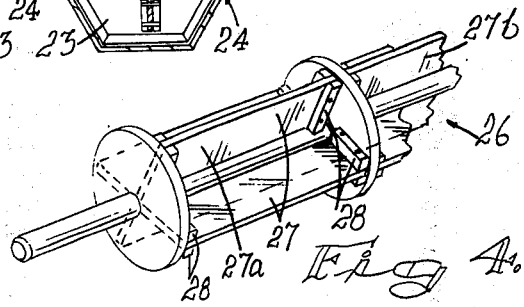
Fig 4.

DESCALING BENT ROD WITH SEPARATED CLEANING PARTICLES

BACKGROUND OF THE INVENTION

This invention relates to descaling equipment and more particularly to a mechanical descaler for use with hot drawn metal rod.

Descaling of hot drawn metal rod, particularly steel rod, is usually effected in two stages. The rod is first passed through a mechanical break descaling machine including pairs of bending rolls with the axes of one pair at right angles to the other. The rod is then passed through a tank of suitable descaling liquid, usually as an acid. These acid tanks are expensive to maintain and can cause inconvenience in the disposal of effluent products. Descaling by shot or sand blasting has also not heretofore proved satisfactory because of both the high power required and also because of the limited surface of the rod exposed to the direction of the blast.

It is the object of the present invention to provide a method and simple mechanical means which will effect adequate descaling of a rod.

SUMMARY OF THE INVENTION

According to this invention, there is provided a method of descaling a rod comprising forming at least one bend in the rod and rotating the bent portion in an approximately circular path while maintaining it in a space having a distribution of separated cleaning particles therein in a suspended relationship relative thereto.

A further feature of the invention provides for the rod to be drawn through the space with the bend in the rod being maintained in said space.

The invention also provides rod descaling means comprising an enclosure having spaced inlet and outlet openings therein, first means for distributing separated cleaning particles in said enclosure, second means for rotating a bent portion of a rod extending between said openings in an approximately circular path, and third means for moving the rod through the enclosure and the openings and maintaining a bent rod portion in the enclosure.

Further features of this aspect of the invention provide for said second means to be a perforated guide eccentrically rotatably mounted adjacent at least one of said openings, for said eccentric guide to be mounted on the inlet opening of the enclosure and to be connected to rotatable, optionally speed variable, drive means, and for said third means to include a rod drawing assembly.

The invention further provides a rod descaling machine comprising a primary mechanical break descaler arranged to feed descaling means as above defined and means for drawing rod through the machine.

BRIEF DESCRIPTION OF THE DRAWINGS

A preferred embodiment of this invention is described below with reference to the accompanying drawings in which:

FIG. 1 is a diagrammatic representation of a rod descaling machine;

FIG. 2 is a cross-sectional side elevation of descaling means according to this invention;

FIG. 3 is a cross-sectional view taken along lines III — III in FIG. 2;

FIG. 4 is an oblique view of part of a rotatable paddle included in the descaling means.

DETAILED DESCRIPTION OF THE PREFERRED EMBODIMENTS

Figure 5:
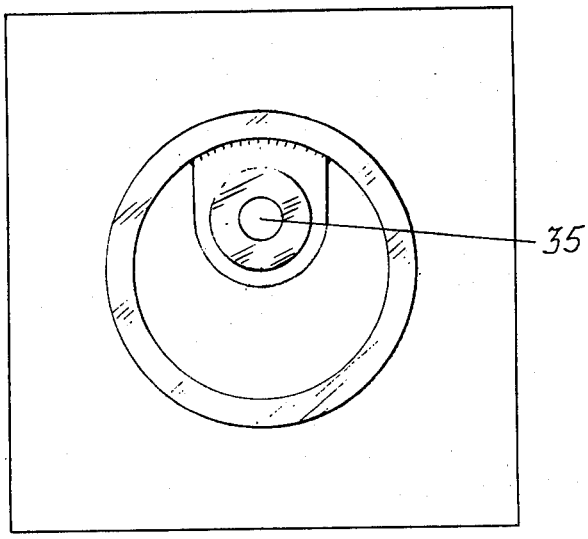
FIGS. 5 and 6 are details of certain components of the descaling means.

With reference to FIG. 1, a machine assembly for the cold descaling of hot drawn metal rod 1 comprises a stand 2 for holding a roll 3 of rod, and an eye 4 through which the rod is fed to reduce snarling of the latter. The rod is fed through a primary mechanical break descaler 5 of a known type which is illustrated diagrammatically in FIG. 1. The primary descaler 5 includes pairs of bending rolls with the axes of certain pairs at right angles to other pairs so that some of the scale on the rod is effectively cracked off the rod. The last pair of rolls of the descaler are located to feed rod passed therethrough into descaling means 6 described more fully below.

Briefly, the descaling means 6 includes an enclosure 19 and means 9 for distributing separated cleaning particles therein.

After the descaling means 6, the rod passes to a drawing assembly 7 located at the outlet end of the former and which includes a drawing roll 8. Through the descaling means 6 the rod is both fed by the descaler 5 and is drawn by the drawing roll 8 so that it is positively held on opposite sides of the means.

Figure 6:
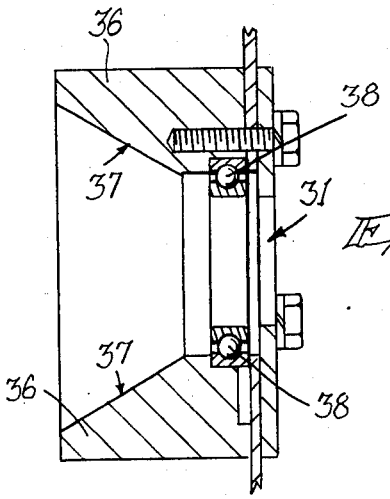

As shown in FIGS. 2 to 6, the descaling means comprises an enclosure 19 having side and end walls 20 and 21. The end walls 21 are downwardly and inwardly inclined near the bottom of the enclosure as shown at 22. The bottom of the enclosure is formed by two spaced parallel wells 23 having inwardly inclined sides 24. The enclosure is mounted on a support 25.

In this embodiment, the means 9 comprises a paddle 26 rotatably mounted in each well about a horizontal axis parallel to the length of the latter. Each paddle has four blades 27 extending at right angles to one another and is coupled externally to an electric motor 39 conveniently mounted beneath the one inclined end wall 22 on the support 25.

Each paddle blade 27 comprises two contiguous portions 27*a* and 27*b* releasably, and hence replaceably, attached to the paddle shaft. The attachment, in this embodiment, is accomplished by means of retaining blocks 28 secured to the paddle shaft and pins 29 which pass through apertures in the blocks and in the adjacent blade portions.

The end walls 21 of the enclosure have an inlet opening 30 and an outlet opening 31 therein. An imaginary line between these openings is horizontal and parallel to the length of the enclosure. In the inlet opening 30, a perforated guide 32 is rotatably mounted in suitable bearings and is eccentrically coupled to a shaft 33. The shaft in turn is connected to an electric motor (34). The latter is mounted on the support 25 and drives the shaft 33 through belts. Preferably, the drive is arranged to be of variable speed.

The aperture 35 (FIG. 5) in the guide communicates with a passage (not shown) extending axially through the drive shaft 33.

A guide ring 36 is secured to the inside of the other end wall of the enclosure surrounding the outlet opening 31. The inner surface 37 of the ring tapers outwardly into the enclosure and a ball race assembly 38 is located in the ring inside and adjacent the end wall.

In use, rod 1 from the primary descaler is drawn by means of the drawing roll 8 through the aperture 35 in the eccentric guide at the inlet opening and through the guide ring 36 at the outlet of the descaling means. A suitable particulate cleaning substance, for instance metal shot, sand or other abrasive, is introduced into the enclosure and gravitates to the wells 23. The electric motor 28 coupled to th paddles is activated and the latter fling the cleaning particles up into the space defined in the enclosure. The particles are thus distributed throughout the space and are contained by the enclosure. As the particles fall down, they are directed into the wells by the inclined sides of the latter and the inclined end walls of the enclosure, whereupon they are again flung upwardly.

At the same time, the electric motor 34 coupled to the eccentric guide 32 is activated to rotate the latter. As a result, the end of the rod passing through the eccentric guide is rotated in a circular path and the centrifugal force arising bows the rod portion in the housing outwardly into a bent configuration. The feed and drawing means for the rod are arranged so that a certain amount of slack is encountered in the rod to allow this bending. The bent portion is consequently flexed and rotated in a circular path about an axis extending between the eccentric guide and outlet opening. During this motion, the rod is held in tension by the centrifuging motion and by the feed rolls and drawing capstan. As the rod is drawn through the enclosure, the bend is continuously being formed and removed at the inlet and outlet openings respectively. The tapering ring 36 and ball race assembly 38 at the outlet guide the outgoing rod smoothly through the outlet opening.

The rod in the enclosure is thus moved around through the cleaning particles distributed in the enclosure and is brought into contact therewith. The manner of rotation of the bent rod portion ensures that the whole surface of the rod strikes the particles and is cleaned thereby.

The speed of rotation and degree of bending of the rod 1 is controlled to obtain final descaling without pitting of the rod surface.

Different rods may require the components and operational speeds to be varied, but the optimum conditions will be readily ascertained with a limited number of trial operations of the machine.

Other embodiments of the invention, although not illustrated, are envisaged within the scope of this invention. It may be necessary or convenient to provide a rubber baffle or the like at the outlet opening to prevent cleaning particles which might adhere to the rod from escaping through this opening. The eccentric could be mounted in the outlet opening instead of the inlet and, furthermore, both openings could be provided with synchronized rotatable eccentrics.

Other means for effecting bending and rotation of the rod are envisaged. One such alternative comprises a rotatable tube in the enclosure carrying a pair of rod guides spaced from its axis and from each other; a slot is provided in the tube near each guide remote from the other guide and the rod is threaded into the tube, through a slot and guide and bent away and back into the tube through the other guide and slot.

The means 9 provided to distribute cleaning shot or sand in a separated state within the enclosure, illustrated diagrammatically in FIG. 1, can be any suitable arrangement. For example the enclosure could be a rotatable drum with slots to carry the shot into the upper region and allow it to fall across the interior of the enclosure. Alternatively the enclosure could be pressurized in a manner which allows the cleaning particles to form a fluidized bed. In another variation the floor of the enclosure may comprise a vibrator to throw particles falling thereon upwardly into the enclosure. A Jacobs ladder could also possibly be used to obtain a continuous withdrawal of material from the bottom of the enclosure and discharge of this back into the top.

In all cases, however, the invention provides relatively simple mechanical means which will effect adequate descaling of a rod.

What I claim as new and desire to secure by Letters Patent is:

1. A method of descaling rod comprising the steps of providing a distribution of separated cleaning particles in an enclosed space, forming at least one bent portion in a rod to be descaled in said enclosed space, and rotating the bent portion in an approximately circular path in the enclosed space such that said bent portion strikes said cleaning particles.

2. A method as claimed in claim 1 in which the rod is drawn through the enclosed space with the bent portion in the rod being maintained in the space.

3. Rod descaling means comprising an enclosure having spaced inlet and outlet openings therein, first means for distributing separated cleaning particles in said enclosure, second means for forming a bent portion in a rod extending between said openings and rotating the bent portion in an approximately circular path such that said bent portion strikes the particles in said enclosure, and third means for moving the rod through the enclosure between the openings and maintaining the bent portion in the enclosure.

4. Descaling means as claimed in claim 3 in which said second means is a perforated guide eccentrically rotatably mounted adjacent at least one of said openings, the rod passing through the perforated guide in use.

5. Descaling means as claimed in claim 4 in which said perforated guide is eccentrically mounted in the inlet opening of the enclosure and is connected to rotatable drive means.

6. Descaling means as claimed in claim 5 in which said rotatable drive means is a variable speed electric motor.

7. Descaling means as claimed in claim 3 in which said third means includes a drawing roll.

8. Descaling means as claimed in claim 3 in which the openings are located such that they lie in a horizontal plane.

9. Descaling means as claimed in claim 3 in which said first means comprises at least one rotatable paddle mounted in a well at the bottom of the enclosure about a horizontal axis.

10. Descaling means as claimed in claim 9 in which two rotatable paddles are mounted in two transversely spaced parallel wells having downwardly inwardly inclined sides.

11. Descaling means as claimed in claim 9 in which said paddle has a plurality of blades releasably attached thereto.

* * * * *